United States Patent [19]

Dufresne

[11] Patent Number: 4,521,067

[45] Date of Patent: Jun. 4, 1985

[54] NON-CONDUCTIVE BATTERY CABLE CONNECTOR AND ELECTRICALLY CONDUCTIVE CLIP FOR USE THEREWITH

[76] Inventor: Raymond A. Dufresne, 527 W. Townley Ave., Phoenix, Ariz. 85021

[21] Appl. No.: 463,281

[22] Filed: Feb. 2, 1983

Related U.S. Application Data

[63] Continuation-in-part of Ser. No. 196,868, Oct. 14, 1980, Pat. No. 4,372,636, and a continuation-in-part of Ser. No. 124,979, Feb. 27, 1980, abandoned, and a continuation-in-part of Ser. No. 135,348, Mar. 31, 1980, abandoned.

[51] Int. Cl.[3] ..... H01R 11/22; H01R 11/26

[52] U.S. Cl. ..... 339/237; 339/228

[58] Field of Search ..... 339/224–240

[56] References Cited

U.S. PATENT DOCUMENTS

| | | | |
|---|---|---|---|
| 2,844,806 | 7/1958 | McKissick | 339/232 X |
| 2,887,668 | 5/1959 | Sherno | 339/239 X |
| 2,925,579 | 2/1960 | Osborn | 339/237 X |
| 3,064,231 | 11/1962 | Satrum | 339/228 |
| 3,694,798 | 9/1972 | Julian | 339/237 X |
| 3,829,823 | 8/1979 | Dumesnil | 339/228 |

FOREIGN PATENT DOCUMENTS

| | | | |
|---|---|---|---|
| 774663 | 9/1934 | France | 339/232 |
| 1010106 | 3/1952 | France | 339/232 |

*Primary Examiner*—Eugene F. Desmond

*Attorney, Agent, or Firm*—Herbert E. Haynes, Jr.

[57] ABSTRACT

Battery cable clamps (10, 110, 210, 310, 410) constructed from an electrically non-conductive, dielectric, material so as to prevent corrosion, and associated therewith a clip (44) constructed from an electrically conductive material so as to permit easy connection of external electrical equipment, jumper cables, and the like, to a battery post associated with the connector.

13 Claims, 11 Drawing Figures

NON-CONDUCTIVE BATTERY CABLE CONNECTOR AND ELECTRICALLY CONDUCTIVE CLIP FOR USE THEREWITH

CROSS-REFERENCE TO RELATED APPLICATIONS

This application is a Continuation-in-Part of my copending U.S. patent application Ser. No. 196,868, filed Oct. 14, 1980, and entitled BATTERY CONNECTOR now U.S. Pat. No. 4,372,636, issued Feb. 8, 1983, and of my prior U.S. patent application Ser. No. 124,979, filed Feb. 27, 1980, and entitled BATTERY CONNECTOR, and Ser. No. 135,348, filed Mar. 31, 1980, and entitled CORROSION-PROOF BATTERY CONNECTOR, and both now abandoned.

BACKGROUND OF THE INVENTION

1. Field of the Invention

This invention relates generally to battery connectors, and more particularly to non-conductive, corrosion resistant battery connectors and electrically conductive clip for use therewith during battery charging, jumping, and testing operations.

2. Description of the Prior Art

My prior U.S. patent application—Ser. Nos. 124,979; 135,348; and 196,868—disclose various embodiments of battery connectors constructed from an electrically non-conductive material, such as nylon, rubber, and the like, which are intended to eliminate the corrosion problems encountered with the conventional split lead clamps commonly used to connect battery cables to conventional motor vehicle lead-lead-acid storage batteries, and the like. One disadvantage to using these corrosion-free battery connectors, however, is the difficulty in making connections to the associated battery terminals when desired to charge, jump, or test a particular battery. Accordingly, it is desirable that provision be made for facilitating external electrical connection to a battery terminal provided with non-conductive battery cable connectors.

It has been considered to provide modified battery cables having stripped portions of the cable normally covered by a removable piece of dielectric material retained as by a resilient sleeve, tape, and the like, so that the cable strands can be exposed as desired for permitting electrical connection. This approach was found to create insulation and other problems, however.

SUMMARY OF THE INVENTION

It is an object of the present invention to provide a corrosion resistant battery cable connector of simplified construction when compared to other connectors of the same kind.

It is another object of the present invention to provide for in a simple manner external electrical connection to a battery terminal or post having associated therewith a non-conductive battery cable connector.

It is yet another object of the present invention to provide an electrical clip suitable for arrangement on a conventional battery terminal or post so as to permit in a simple and efficient manner electrical connection to the associated battery post.

These and other objects are achieved according to the present invention by providing a clip comprising a generally circular portion having a periphery provided with a gap therein and arrangable on a battery post beneath an associated battery clamp. A pair of substantially parallel, coextensive legs extend from the circular portion so as to be arrangable for engagement by a suitable electrical connector, such as are conventionally known and commonly used in conjunction with storage batteries. The clip preferably is constructed as one piece from a resilient, electrically conductive material, with the legs of same being formed in two sections. The first of the sections preferably extends from the periphery of the circular portion at a respective side of the gap formed therein, and diverges from the first of the sections of the other of the legs, with a second of the sections extending from the first of the sections and slightly converging toward the second of the sections of the other of the legs.

A clip according to the present invention is specifically intended for use with non-conductive, corrosion resistant battery cable connectors generally comprising a cup-shaped member constructed from a dielectric or non-conductive material and arrangable on an associated battery post so as to retain the opposed strands of an associated battery cable in electrical contact with the post. Some manner of assuring that the cup-shaped member continuously biases the battery cable strands against the associated post preferably is provided.

An advantage of the present invention is that a non-corrosive connection of a battery cable to an associated battery post can be made in a simple yet efficient manner.

Another advantage of the present invention is that the use of a non-conductive battery cable connector does not hinder electrical connection to the battery post for charging, jumping, and testing operations and the like.

The foregoing and other objects of this invention, as well as the invention itself, may be more fully understood when read in conjunction with the following drawings.

DESCRIPTION OF THE PREFERRED EMBODIMENTS

Figure 1:
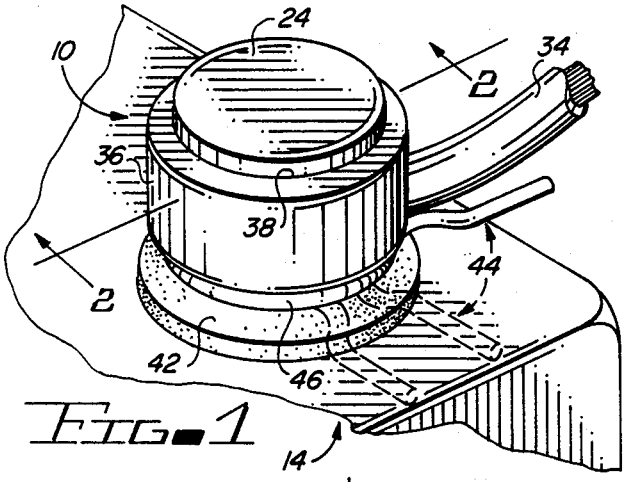
FIG. 1 is a fragmentary, perspective view showing a preferred embodiment of a battery cable connector and associated electrical clip in accordance with the present invention.
Figure 2:
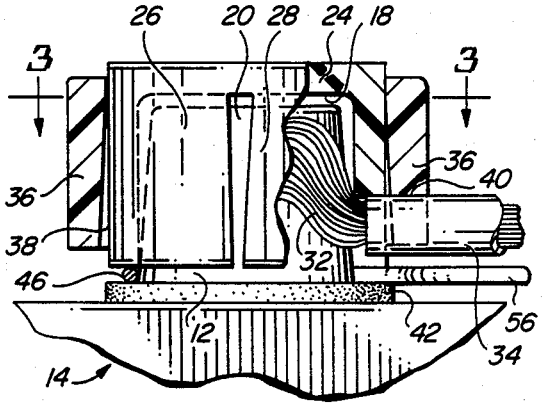
FIG. 2 is an enlarged, fragmentary, sectional view taken generally along the line 2—2 of FIG. 1.
Figure 4:
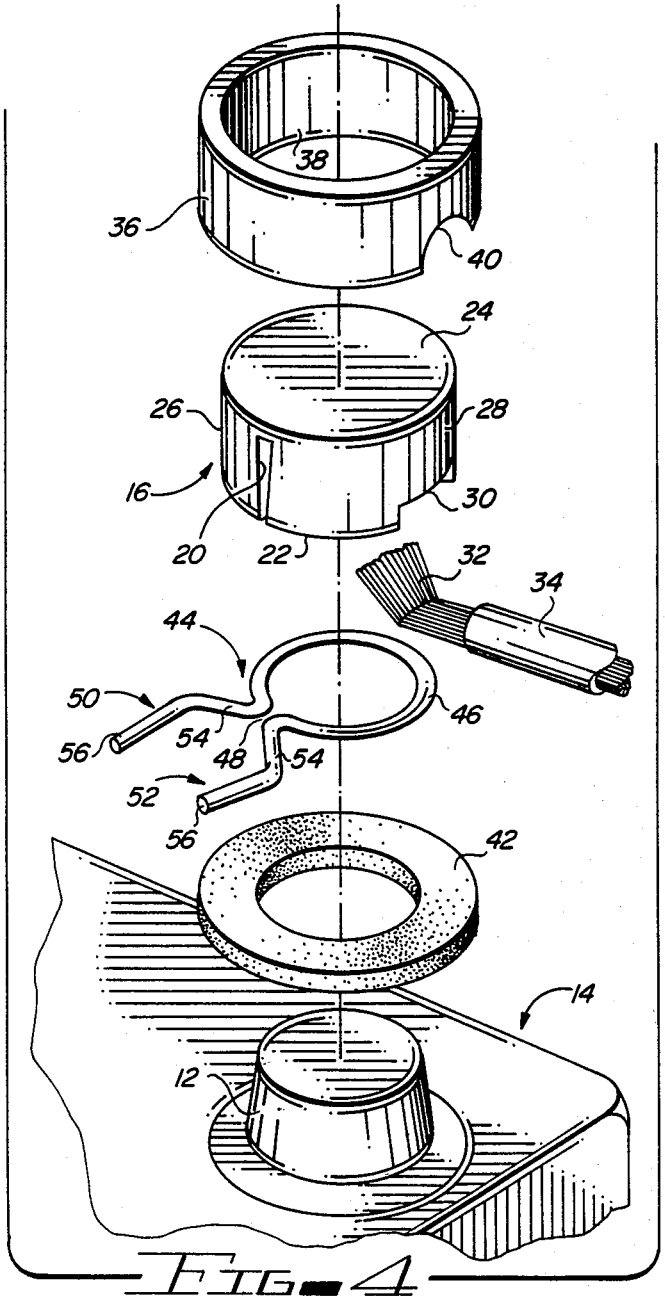
FIG. 4 is an exploded, perspective view showing the battery cable connector embodiment and associated clip as illustrated in FIGS. 1 through 3.
Figure 3:
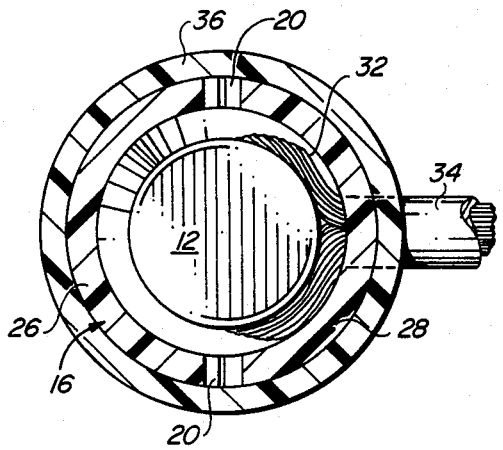
FIG. 3 is a sectional view, with some parts removed for clarity, taken generally along the line 3—3 of FIG. 2.

Referring now more particularly to FIGS. 1 through 4 of the drawings, a battery cable connector 10 according to the present invention is illustrated as installed on a conventional, tapered battery post 12 of a conventional storage battery 14 such as commonly used in, for example, automotive vehicles. Such batteries are usually of lead-lead-acid construction, and have a pair of terminals or posts, one positive, one negative, extending outwardly therefrom usually from an upwardly disposed surface. Since such batteries are well known and commonly employed, the construction of battery 14 will not be described in detail herein.

Connector 10 comprises a connector arrangement including a clamping cap 16, preferably of the illustrated cylindrical configuration, provided with a socket or blind bore 18 formed axially therein. A sidewall of clamping cap 16 is provided with a pair of diametrically opposed slits 20 which are generally rectangular in configuration when cap 16 is unflexed, and which extend axially from an edge 22 of cap 16 surrounding an opening into bore 18 toward a closed top 24 of cap 16 so that slits 20 divide the sidewall of cap 16 into an opposed pair of legs 26 and 28. The latter are semicircular in cross section, with leg 28 being provided with a notch 30 of generally rectangular configuration which permits conductive strands 32 of a conventional battery cable 34 to be introduced into blind bore 18 of cap 16.

To install a clamping cap 16, a terminal post 12 of a battery 14, conductive strands 32 of a cable 34 are spread to a more or less flattened, or fanned-out, state within bore 18 of cap 16, and cap 16 then is axially pushed onto a post 12 so as to cause the more or less flattened array of conductive strands 32 to extend axially and wrap around approximately ½ of a peripheral surface of the post 12. Bore 18 of cap 16 is sized so that when the conductive strands 32 of a battery cable 34 ar disposed within bore 18, in the manner described above, an interference fit results which deflects the legs 26 and 28 of cap 16 somewhat. The preferred construction of cap 16 is from a resilient material, such as polypropylene with glass filler, which causes legs 26 and 28 to exert a gripping force against strands 32 which firmly holds same in conductive contact with the associated surface of the post 12.

During installation of a cap 16 on an associated battery post 12, conductive strands 32 of a cable 34 being connected will slide axially relative to the peripheral surface of the associated post 12 so as to provide a wiping action which cleans and reduces metal irregularities in the surface of the associated post 12. This results in an excellent conductive contact which is substantially gas-tight to reduce occurrence of corrosion buildup between the strands 32 and the post 12.

In addition to being electrically non-conductive, or dielectric, and resilient, a preferred material for constructing clamping cap 16 should also be able to resist the deteriorating effects of the very hostile environment associated with a storage battery 14. In addition, such material should be able to resist creep, that is the slow change in its dimensions and configuration due to prolonged exposure to stress.

In order to prevent excessive creeping of the resiliently deflecting legs 26 and 28 of a clamping cap 16, over a prolonged period of use, connector 10 also includes a retainer sleeve 32 preferably constructed in the illustrated cylindrical configuration forming an internal cavity 38 by an inner surface closely conforming to an outer surface of clamping cap 16, and being provided with a recess 40 along one end edge thereof for conformingly fitting over an upper portion of a shielded section of an associated battery cable 34. When sleeve 36, which can be nylon with a talc filler, is disposed embracing cap 16, it will hold the legs 26 and 28 in place so as to guard against the aforementioned problem of creep.

A conventional fiber washer, and the like, advantageously is arranged on an associated battery post 12 beneath connector 10 as is conventionally used to help prevent corrosion from battery acid fumes which attack all metal parts, such as cable strands 32 and an electrical clip as to be described below, in order to protect these parts.

A clip 44 according to the present invention for use with an electrically non-conductive battery clamp such as connector 10 comprises a generally circular portion 46 having a periphery provided with a gap 48 and arrangable on a battery post 12 beneath an electrically non-conductive connector 10. Clip 44 further includes a pair of substantially parallel, coextensive legs 50 and 52 disposed extending from circular portion 46 and arrangable for engagement by a suitable electrical connector (not shown) such as that commonly provided on battery jumper cables, and the like.

Clip 44, which is constructed as one piece from a resilient, or springy, electrically conductive material, such as copper, brass, and the like, preferably has legs 50 and 52 formed in two sections 54 and 56. Each of the first sections 54 extends from circular portion 46 at a respective side of gap 48 and diverges from the first section 54 of the other of the legs 52, 50, while the second section 56 extends from the associated section 54 and slightly converges toward the section 56 of the other of the legs 52, 50. By this arrangement, it will be appreciated that the jaws of a conventional electrical connector (not shown) can grippingly engage sections 56 of legs 50, 52, in order to force circular portion 46 of clip 44 firmly against the outer surface of battery post 12 in order to assure good electrical connection between clip 44 and post 12.

Figure 5:
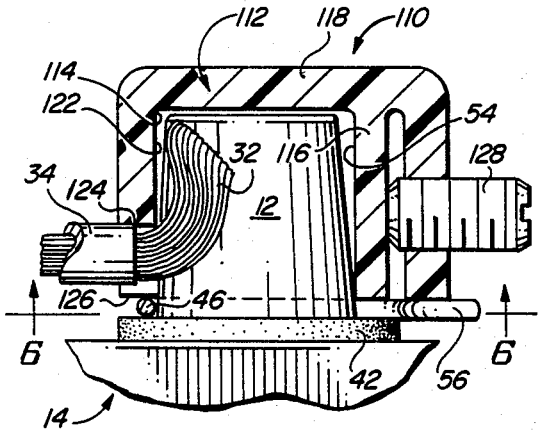
FIG. 5 is a vertical sectional view taken through a second embodiment of a connector according to the present invention.
Figure 6:
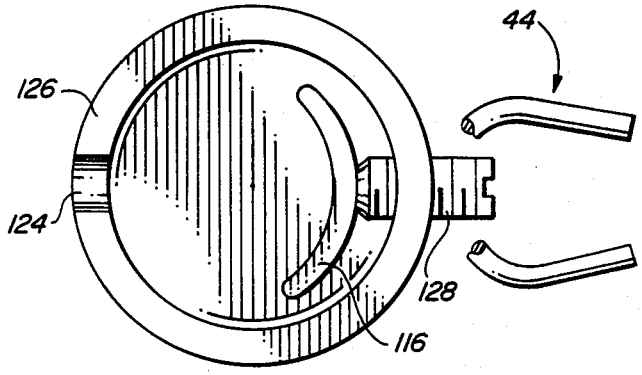
FIG. 6 is a bottom plan view thereof taken generally along the line 6—6 of FIG. 5, but with most of the clip removed for clarity.

Referring now more particularly to FIGS. 5 and 6 of the drawings, a further connector 110 according to the present invention includes a clamping cap 112 constructed from a material as discussed above and provided with a socket or blind bore 114. Cap 112, which may be molded, machined from stock materials, and the like, is provided with a deflectible member 116 arcuate in cross section, and which may be described as a leg integral with a closed top 118 of cap 112 and arranged extending into bore 114. This deflectible member 116 is offset toward one side of bore 114, as seen best in FIG. 6, so that the distance between this inwardly facing concave surface 120 and a diametrically opposed portion 122 of bore 114 is approximately equal to the diameter of the tapered battery post 12. A notch 124 advantageously is provided in an edge 126 of cap 112 which circumscribes an opening to bore 114, and is disposed in portion 122 of the sidewall of cap 112 so as to be opposite the deflectible leg 116.

To install a connector 110, conductive strands 32 of a battery cable 34 are inserted, in a flattened or fanned-out array, into blind bore 114, and cap 112 is slidably pushed onto an associated battery post 12. When cap 112 is being installed in this manner, conductive strands 32 will wipe the peripheral surface of the post 12 and be repositioned so as to extend substantially axially of the post 12 and wrap around approximately ½ of same. The relatively close tolerance fit of the deflectible member 116 and the diametrically opposed portion 122 of bore 114 will exert a clamping force to press the conductive strands 32 so as to force same into conductive contact with the peripheral surface of the post 12. This clamping force is augmented and restrained by a set screw 128 preferably constructed from a non-conducting material, such as nylon, and threadingly received in a threaded socked provided in the sidewall of cap 112 so that it can be brought into bearing engagement with the concave surface of deflectible member 116. In addition to augmenting the clamping force, set screw 128 will function in a similar manner to retainer sleeve 36 and prevent creeping of member 116.

Figure 7:
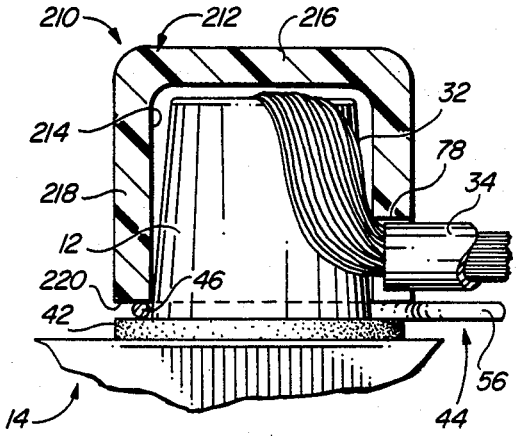
FIG. 7 is a vertical sectional view, similar to FIG. 4, but showing yet another embodiment of a battery connector and electrical clip assembly according to the present invention.

Referring now to FIG. 7, a connector 210 is illustrated which includes a clamping cap 212 constructed by conventional techniques preferably from materials as described above and which is provided with a recess or blind bore 214 formed axially therein. Clamping cap 212 is defined by a closed top 216 provided with an integrally extending endless sidewall 218. An extending edge 220 of sidewall 218 is provided with a notch 222 arranged for receiving a shielded portion of a battery cable 34 so as to permit the fanned-out, or substantially flattened, conductive strands 32 of an associated battery cable 34 to be introduced into bore 214 of cap 212. Bore 214 of cap 212 is sized to provide an interference fit with an associated battery post 12 so that when connector 210 is slidingly assembled on the post 12, the strands 32 will wipe post 12 and be repositioned to substantially conform thereto; with the inherent resiliency of cap 212 exerting a retaining force on strands 32.

It will be noted that battery connectors 10, 110, and 210 described above easily can be sealed by the aforementioned washers 42 to protect a connection between cooperating battery post 12 and conductive strands 32 from the corrosive battery environment. In addition, the washer 42 can be treated as is conventionally known to prevent corrosion, and as a further alternative a suitable material, such as silicone grease, and the like.

Figure 8:
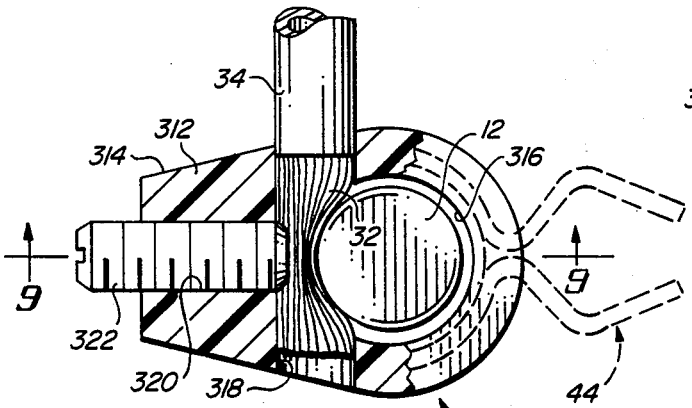
FIG. 8 is a top plan view, partially broken away and in section, illustrating yet another embodiment of a battery connector and clip combination according to the present invention.
Figure 9:
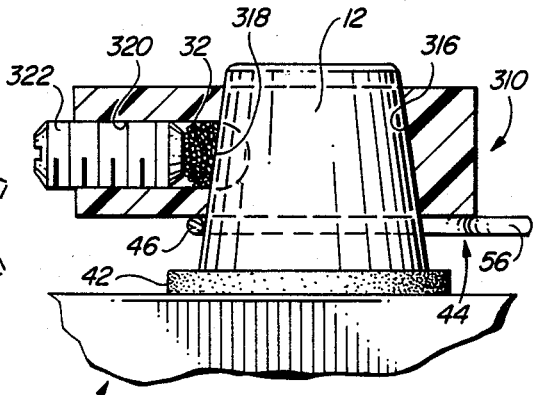
FIG. 9 is a sectional view taken generally along the line 9—9 of FIG. 8.

An embodiment of the present invention wherein a treated washer 42 is particularly important is illustrated in FIGS. 8 and 9 of the drawings. In this embodiment, a connector 310 according to the present invention comprises a connector body 312 constructed in a conventional manner from materials as described above and defining an endless sidewall 314 having a bore 316 provided therein and arranged to extend between opposite planar surfaces of body 312. As can be appreciated, the nature of body 312 does not permit sealing between the upper surface of a battery 14 and the lower planar surface of body 312, so that it becomes more important to use a treated washer 42, and the like.

A second, or cross-bore 318 is drilled or otherwise formed through the sidewall 314 of body 312 so that the centerline of this cross-bore 318 is tangential with respect to the circular cross-section, or circumference, of an associated battery post 12 received in bore 316. Cross-bore 318 is sized to receive an unshielded portion of an associated battery cable 34 and permit the conductive strands 32 associated therewith to be arranged extending transversely through bore 316 in an off-center relation. When body 312 is slidingly assembled onto battery post 12, that portion of the conductive strands 32 which extend transversely through bore 316 will wipingly engage the peripheral surface of the battery post 12, and those strands will be forced out of the bore 316 and in response to this force will become very densely packed in the cross-bore 318. A third bore 320 is formed in body 312 so as to lie in the same plane as cross-bore 318 and in a position so that it normally intersects cross-bore 318 at a point where the centerline of bore 320 is tangential to the circumference of battery post 12 received in bore 316. Bore 320 preferably is internally threaded, with a conventional set screw 322, constructed from nylon, and the like, being threadingly engagable in bore 320 in order to clampingly retain conductive strands 32 of an associated cable 34 in contact with the peripheral surface of an associated battery post 12.

Figure 10:
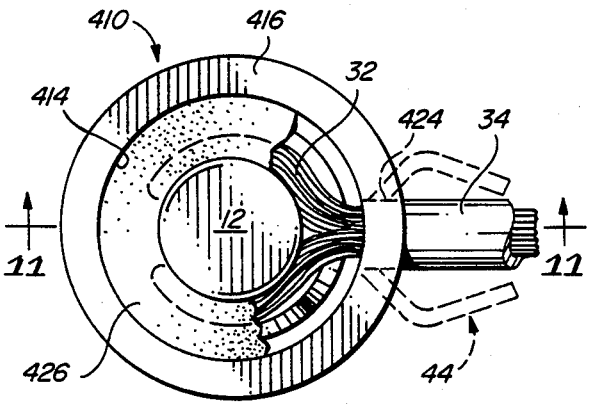
FIG. 10 is a top plan view, partially broken away and in section, illustrating yet another embodiment of a battery connector and clip combination according to the present invention.
Figure 11:
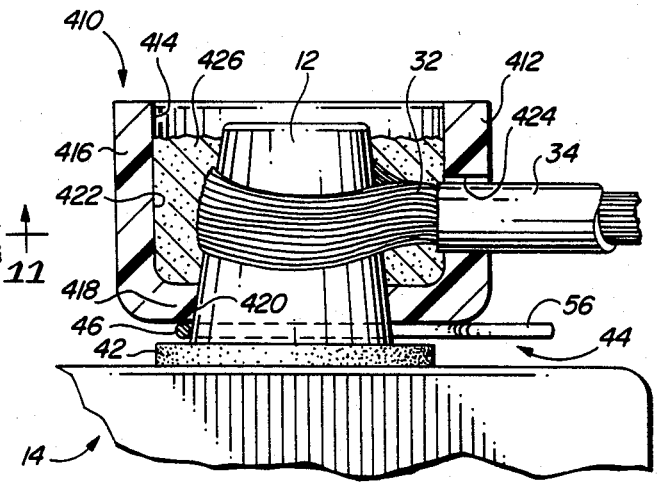
FIG. 11 is a sectional view taken generally along the line 11—11 of FIG. 10.

In FIGS. 10 and 11 of the drawings, a battery connector 410 according to the present invention is shown as comprising a cup-shaped body 412 having an axial bore 414 provided therein and partially defined by an endless sidewall 416 and a bottom wall 418. The latter has a reduced diameter hole 420 provided therethrough and arranged so as to be coaxial with bore 414. Hole 420 is sized so as to substantially match the diameter of an associated tapered battery post 12 receivable axially through hole 420 and into bore 414. The latter, in turn, is sized to provide an annular cavity 422 which surrounds the associated post 12. Sidewall 416 of body 412 has formed therein a radial hole 424 arranged for receiving an unshielded portion of an associated battery cable 34 having extending therefrom, in the usual manner, unshielded conductive strands 32 arrangable around post 12. More specifically, conductive strands 32 preferably are split into two substantially equal portions arrangable straddling post 12 and wound therearound in opposite directions. Once strands 32 are wrapped on post 12, annular cavity 422 is filled with a suitable known compactable conductive material 426, such as granulated or shreaded lead or any other highly malleable material. This malleable material 426 is then tamped or otherwise subjected to compacting forces to form a solid mass which conforms to the interior of the annular cavity 422 and encapsulates terminal post 12 and the associated conductive strands 32.

In both of the embodiments illustrated in FIGS. 8 and 9, and 10 and 11, a clip 44 according to the present invention is disposed on the associated battery post 12 beneath the connector 310, 410. Further, as mentioned above, it is particularly advantageous in conjunction with these two embodiments of the invention to use a treated rubber or felt washer 42 at the base of the associated battery post 12 in order to help prevent corrosion of exposed portions of post 12 and to clip 44. It may also be advisable to pack the exposed ends of strands 32 in bore 318 of connector 310 to prevent corrosion thereof.

As can be readily understood from the above description and from the drawings, battery connectors according to the present invention will permit the use of electrically non-conductive, or dielectric, battery cable connectors without the disadvantage of difficult electrical connection to the associated battery post for charging, jumping, testing, and similar operations. The connectors disclosed herein, together with the associated electrical clip, can be used with any conventional top post commonly found on motor vehicle storage batteries, and the like, and are readily adaptable to various sized post. For example, when using connector 10 (FIGS. 1 through 4) the retainer sleeve, or locking ring 36 can be constructed so that cavity 38 has a slightly greater diameter adjacent recess 40 than at the other opening to cavity 38. Accordingly, if an associated battery post 12 has a loose fit on the clamping cap 16, sleeve 36 can be installed with recess 40 opening upwardly, or inverted from the positions seen in FIG. 4, so as to exert a tighter clamping force on the legs 26 and 28 of caps 16. Most importantly, an electrical clip 44 used with a connector according to the present invention permits electrical connections to an associated battery post without any need for modification of the electrical connector or associated battery cable, as the clip 44 can merely be rotated, for example, 90° from a storage position beneath the associated cable 34 to a position permitting easy access thereto.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An electrically conductive clip in combination with an electrically non-conductive battery cable clamp, comprising:

(a) an electrically non-conductive battery cable clamp positionable on a battery post for electrically connecting a battery cable directly to the battery post; and (b) an electrically conductive clip for permitting electrically conductive connection to the battery post, said clip including, I. a generally circular portion having a periphery with a radial gap therein and arrangeable in substantially circumscribing electrically conductive contact on the battery post beneath said battery cable clamp, II. a pair of substantially parallel, coextensive legs extending integrally from said circular portion for engagement by a suitable electrical connector.

2. A clip as defined in claim 1, wherein each of the legs is formed in two sections, the first of the sections extending from the circular portion at a respective side of the gap provided therein, and diverging from the first of the sections of the other of the legs, and a second of the sections extending from the first of the sections and slightly converging toward the second of the sections of the other of the legs.

3. A clip as defined in claim 1, wherein the clip is constructed as one piece from a resilient, electrically conductive material.

4. In a combination comprising:

(a) a battery cable clamp having a connector member constructed from a dielectrical material for mounting on a battery post, said connector member adapted to directly connect the strands of a battery cable on the battery terminal post;

(b) a clip permitting electrically conductive connection to the battery post associated with said battery cable clamp, said clip comprising a generally circular portion having a periphery provided with a gap therein and arrangeable on the battery post beneath said battery cable clamp, said clip having a pair of substantially parallel, coextensive legs extending from the circular portion for engagement by a suitable electrical connector.

5. A combination as defined in claim 4, further including a sealing washer for positioning on the battery post beneath said clip for sealing the connection of the battery post and the strands of the battery cable.

6. The combination as defined in claim 4, wherein said clip is constructed as one piece from a resilient, electrically conductive material.

7. The combination as defined in claim 4, wherein each of the legs of said clip is formed in two sections, the first of the sections extending from the circular portion at a respective side of the gap provided therein, and diverging from the first of the sections of the other of the legs, and a second of the sections extending from the first of the sections and slightly converging toward the second of the sections of the other of the legs.

8. The combination as defined in claim 7, wherein said clip is constructed as one piece from a resilient, electrically conductive material.

9. A combination as defined in claim 7, wherein the connector member comprises a block defining a through bore arranged for receiving a battery post, and the battery cable clamp further provided with an access counter-bore arranged perpendicular to and in communication with said bore, and arranged for receiving a battery cable, a set screw, and a screw threaded passage arranged perpendicular to and in communication with both of the bore and the counter bore for threadingly receiving the set screw and arrangable for clamping the cable in place against an associated battery post.

10. A combination as defined in claim 7, wherein the connector member comprises a cup-shaped body defining a bore arranged for receiving a battery post, passage means provided in the body for receiving a battery cable having conductive strands wrapable around the associated post, and a compactible conductive material placable within the body for encapsulating and associated battery post and conductive strands of a battery cable.

11. A battery cable clamp for direct attachment of the conductive strands of a battery cable to the terminal post of a battery and an electrically conductive clip for mounting on the terminal post with said battery cable clamp, comprising:

(a) a battery cable clamp defining an axial bore for axially receiving the conductive strands of the battery cable and for axially receiving the terminal post of the battery for directly connecting the conductive strands to the terminal post, said battery cable clamp being formed of a corrosion resistant dielectric material; and (b) a clip of electrically conductive material having a substantially circular portion for mounting in circumscribing electrically conductive contact on the terminal post in axially displaced relationship with respect to said battery cable clamp, said clip having leg means extending integrally from the circular portion thereof for engagement by a suitable electrical connector.

12. A battery cable clamp and an electrically conductive clip as claimed in claim 11 wherein said battery cable clamp comprises:

(a) a clamping cap having the axial bore of said battery cable clamp and including a top from which at least a pair of resiliently deflectable legs extend with the legs configured to substantially circumscribe the axial bore;

(b) said clamping cap having a notch formed in the extending edge of one of the pair of resiliently deflectable legs through which the conductive strands of the battery cable are introducable into the axial bore of said clamping cap; and (c) said clamping cap having its axial bore sized so that when the conductive strands of the battery cable are introduced therein an interference fit is provided for the axial reception of the terminal post of the battery.

13. A battery cable clamp and an electrically conductive clip as claimed in claim 12 wherein said battery cable clamp further comprises a retainer means demountably positionable on the peripheral surface of said clamping cap for retainingly engaging the resiliently deflectable legs thereof.

* * * * *